US011460232B2

(12) United States Patent
Mitchell et al.

(10) Patent No.: US 11,460,232 B2
(45) Date of Patent: Oct. 4, 2022

(54) DRAINLESS ICE MACHINE WITH CLEANING SYSTEM

(71) Applicant: Haier US Appliance Solutions, Inc., Wilmington, DE (US)

(72) Inventors: Alan Joseph Mitchell, Louisville, KY (US); Brent Alden Junge, Evansville, IN (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 38 days.

(21) Appl. No.: 17/064,753

(22) Filed: Oct. 7, 2020

(65) Prior Publication Data

US 2022/0107127 A1 Apr. 7, 2022

(51) Int. Cl.
*F25C 5/185* (2018.01)
*F25C 1/25* (2018.01)
*F25C 5/20* (2018.01)

(52) U.S. Cl.
CPC ..... *F25C 5/185* (2013.01); *F25C 1/25* (2018.01); *F25C 5/24* (2018.01); *F25C 2400/04* (2013.01); *F25C 2400/10* (2013.01); *F25C 2400/12* (2013.01); *F25C 2400/14* (2013.01); *F25C 2600/04* (2013.01)

(58) Field of Classification Search
CPC .... F25C 5/185; F25C 1/25; F25C 5/24; F25C 2400/04; F25C 2400/10; F25C 2400/12; F25C 2400/14; F25C 2600/04
See application file for complete search history.

(56) References Cited

U.S. PATENT DOCUMENTS 3,744,263 A 7/1973 Corley
5,289,691 A 3/1994 McDougal
6,109,043 A * 8/2000 Lu ..... F25C 1/12 62/135
6,153,105 A 11/2000 Squier
(Continued)

FOREIGN PATENT DOCUMENTS

CN 102727090 A * 10/2012 ..... F25C 1/00
JP 2001289542 A 10/2001
(Continued)

OTHER PUBLICATIONS

Translated_WO-2014065638-A1 (Year: 2014).*
(Continued)

*Primary Examiner* — Elizabeth J Martin
*Assistant Examiner* — Samba Nmn Gaye
(74) *Attorney, Agent, or Firm* — Dority & Manning, P.A.

(57) ABSTRACT

An icemaker appliance includes a cabinet forming an ice storage compartment, a first reservoir provided within the ice storage compartment, a circulation system arranged within the first reservoir, an ice maker provided within the first reservoir to dispense ice into the ice storage compartment, a second reservoir connected to the ice storage compartment, a return line conduit connected to the second reservoir and the first reservoir to direct melt water from the second reservoir to the first reservoir, a second pump provided at the second reservoir to pump melt water through the return line conduit, and a cleanout line having a first end connected to the second reservoir and a second end exposed outside of the cabinet.

20 Claims, 4 Drawing Sheets

(56) References Cited

U.S. PATENT DOCUMENTS

| | | | | |
|---|---|---|---|---|
| 7,841,198 | B2 * | 11/2010 | Bippus | F25C 1/00 62/233 |
| 8,756,950 | B2 | 6/2014 | Brunner | |
| 9,303,903 | B2 | 4/2016 | Boarman et al. | |
| 10,274,238 | B2 * | 4/2019 | Mitchell | C02F 1/008 |
| 10,274,328 | B2 | 4/2019 | Grochocki, Jr. et al. | |
| 2003/0010054 | A1 * | 1/2003 | Esch | F25D 16/00 62/354 |
| 2016/0290697 | A1 * | 10/2016 | Broadbent | F25C 1/25 |
| 2018/0207305 | A1 | 7/2018 | Almblad | |
| 2019/0257565 | A1 | 8/2019 | Broadbent | |

FOREIGN PATENT DOCUMENTS

| | | | | |
|---|---|---|---|---|
| JP | 3665260 | B2 | 6/2007 | |
| JP | 4400068 | B2 | 1/2010 | |
| KR | 2010082189 | A * | 7/2010 | |
| WO | WO-2007068506 | A1 * | 6/2007 | F25C 1/08 |
| WO | WO2007068506 | A1 | 6/2007 | |
| WO | WO2008061179 | A2 | 5/2008 | |
| WO | WO-2014065638 | A1 * | 5/2014 | F25C 1/00 |

OTHER PUBLICATIONS

Translated_WO-2007068506-A1 (Year: 2007).*
Translated_Kim (Year: 2010).*
Translated_Cheong (Year: 2012).*

* cited by examiner

DRAINLESS ICE MACHINE WITH CLEANING SYSTEM

FIELD OF THE INVENTION

The present subject matter relates generally to ice making appliances, and more particularly to stand alone ice making appliances that produce clear ice.

BACKGROUND OF THE INVENTION

Icemaker appliances generally include an ice maker that is configured to generate ice. Ice makers within icemaker appliances are plumbed to a water supply, and water from the water supply may flow to the ice maker within the icemaker appliances. Icemaker appliances are frequently cooled by a sealed system, and heat transfer between liquid water in the ice maker and refrigerant of the sealed system generates ice.

In certain icemaker appliances, stored ice within the icemaker appliances melts over time and generates liquid meltwater. Commonly, the icemaker appliances are plumbed to an external drain (e.g., connected to a municipal water system) to dispose of the liquid meltwater. While effective for managing the liquid meltwater, external drain lines have drawbacks. For example, external drain lines can be expensive to install. In addition, external drain lines can be difficult to install in certain locations. Additionally, cleaning such icemaker appliances can be burdensome and time consuming.

Accordingly, an icemaker appliance with features for operating without an external drain line would be useful. In particular, an icemaker appliance with a cleaning system would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an icemaker appliance is provided. The icemaker appliance may include a cabinet forming an ice storage compartment, a first reservoir provided within the ice storage compartment, and a circulation system arranged within the first reservoir. The circulation system may include a first circulation conduit, a first pump connected to the first circulation conduit to pump liquid through the first circulation conduit, and a nozzle downstream from the first circulation conduit to dispense the liquid from the first circulation conduit. The icemaker appliance may further include an ice maker provided within the first reservoir to dispense ice into the ice storage compartment, a second reservoir in fluid communication with the ice storage compartment, a return line conduit connected to the second reservoir and the first reservoir to direct melt water from the second reservoir to the first reservoir, a second pump provided at the second reservoir to pump melt water through the return line conduit, and a cleanout line having a first end connected to the second reservoir and a second end exposed outside of the cabinet.

According to another exemplary aspect of the present disclosure, an icemaker appliance is provided. The icemaker appliance may include a cabinet forming an ice storage compartment, a first reservoir provided within the ice storage compartment, and a circulation system arranged within the first reservoir. The circulation system may include a first circulation conduit, a first pump connected to the first circulation conduit to pump liquid through the first circulation conduit, and a nozzle downstream from the first circulation conduit to dispense the liquid from the first circulation conduit. The icemaker appliance may further include an ice maker provided within the first reservoir to dispense ice into the ice storage compartment, a return line conduit connected to the ice storage compartment and the first reservoir to direct melt water from the ice storage compartment to the first reservoir, a second pump provided in the ice storage compartment to pump the melt water through the return line conduit, and a cleanout line having a first end connected to the second reservoir and a second end exposed outside of the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
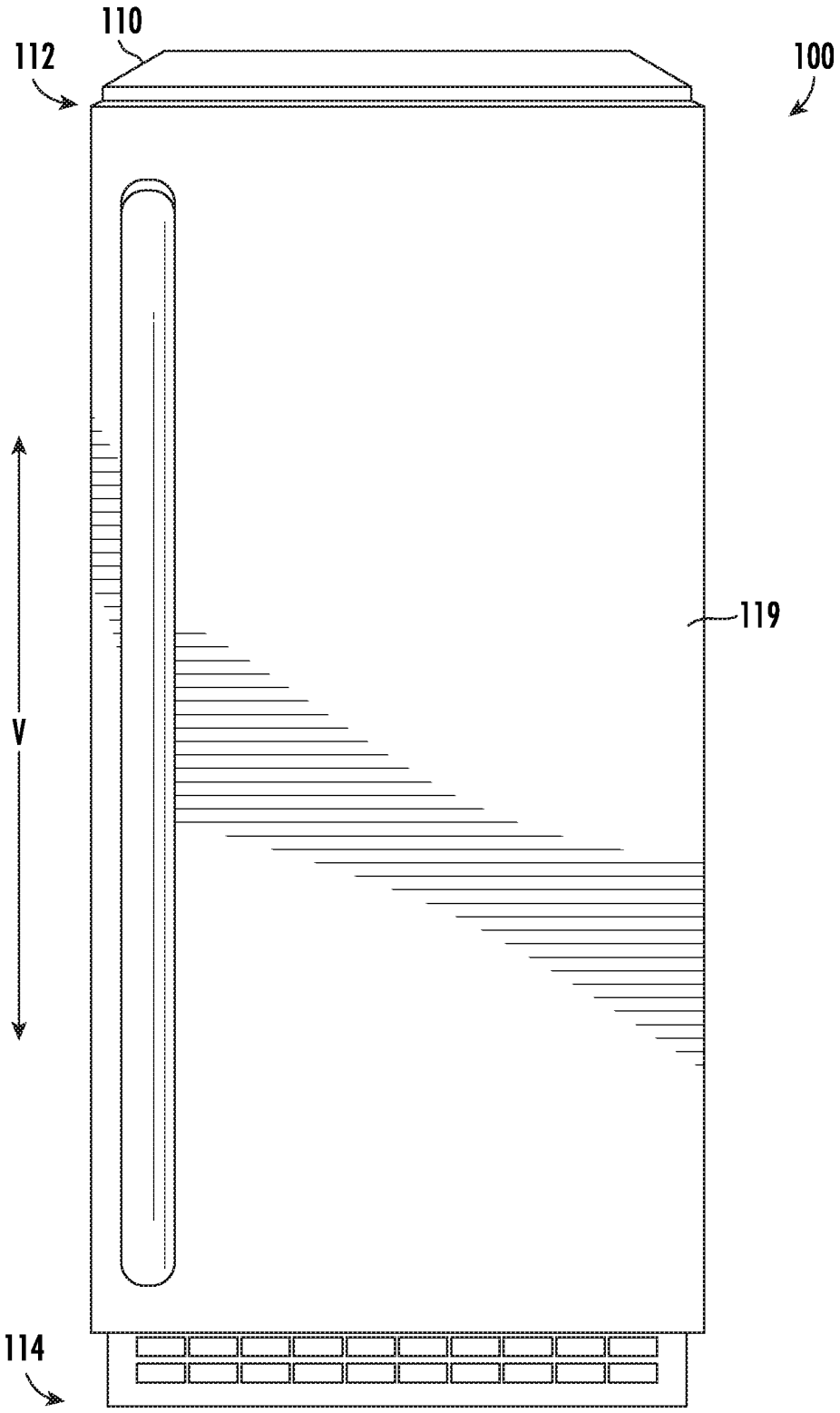
FIG. 1 provides a front, perspective view of an icemaker appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
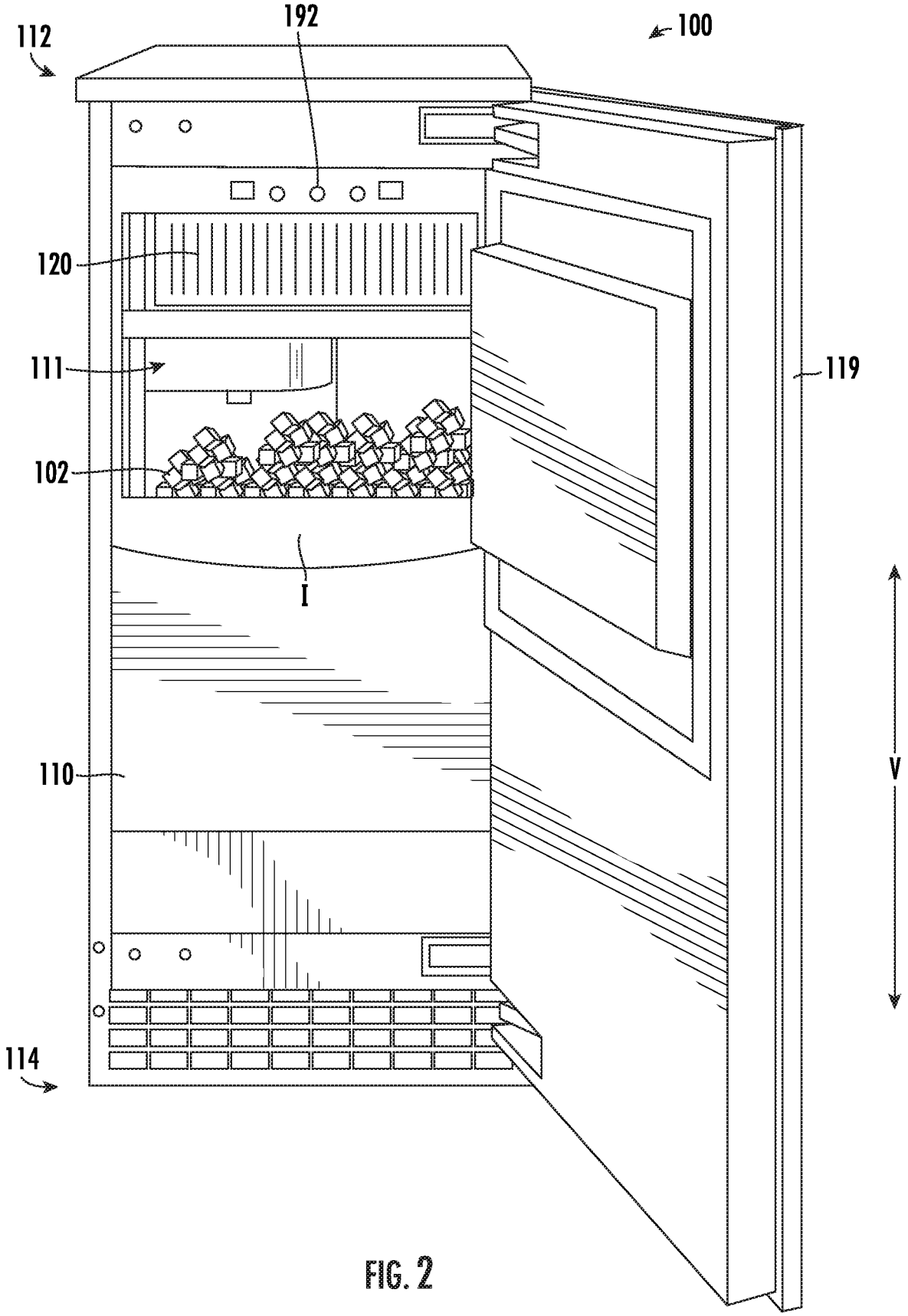
FIG. 2 provides a front, perspective view of the example icemaker appliance of FIG. 1 with a door of the example icemaker appliance shown in an open position.

FIGS. 1 and 2 provide front, perspective views of an icemaker appliance 100 according to an example embodiment of the present subject matter. As discussed in greater detail below, icemaker appliance 100 includes features for generating or producing clear ice. Thus, a user of icemaker appliance 100 may consume clear ice stored within icemaker appliance 100. As may be seen in FIG. 1, icemaker appliance 100 defines a vertical direction V.

Icemaker appliance 100 includes a cabinet 110. Cabinet 110 may be insulated in order to limit heat transfer between an interior volume 111 (FIG. 2) of cabinet 110 and ambient atmosphere. Cabinet 110 extends between a top portion 112 and a bottom portion 114, e.g., along the vertical direction V.

Thus, top and bottom portions 112, 114 of cabinet 110 are spaced apart from each other, e.g., along the vertical direction V. A door 119 is mounted to cabinet 110 at a front portion of cabinet 110. Door 119 permits selective access to interior volume 111 of cabinet 110. For example, door 119 is shown in a closed position in FIG. 1, and door 119 is shown in an open position in FIG. 2. A user may rotate door between the open and closed positions to access interior volume 111 of cabinet 110.

As may be seen in FIG. 2, various components of icemaker appliance 100 are positioned within interior volume 111 of cabinet 110. In particular, icemaker appliance 100 includes an ice maker 120 disposed within interior volume 111 of cabinet 110, e.g., at top portion 112 of cabinet 110. Ice maker 120 is configured for producing clear ice I. Ice maker 120 may be configured for making any suitable type of clear ice. Thus, e.g., ice maker 120 may be a clear cube ice maker, as would be understood.

Icemaker assembly 100 also includes an ice storage compartment or storage bin 102. Storage bin 102 is disposed within interior volume 111 of cabinet 110. In particular, storage bin 102 may be positioned, e.g., directly, below ice maker 120 along the vertical direction V. Thus, storage bin 102 is positioned for receiving clear ice I from ice maker 120 and is configured for storing the clear ice I therein. It will be understood that storage bin 102 may be maintained at a temperature greater than the freezing point of water. Thus, the clear ice I within storage bin 102 melts over time while stored within storage bin 102. As discussed in greater detail below, icemaker appliance 100 includes features for recirculating liquid meltwater from storage bin 102 to ice maker 120.

Figure 3:
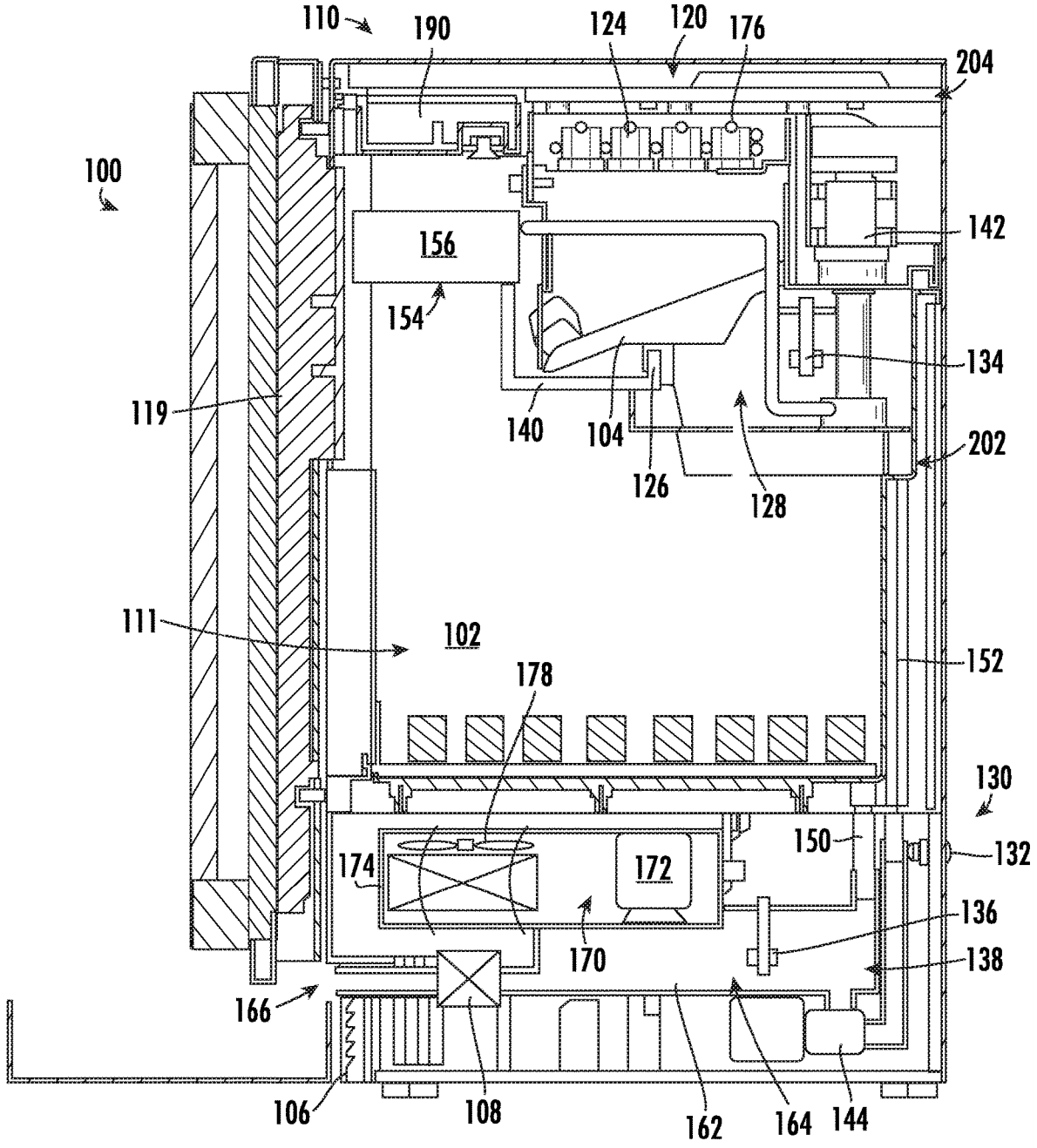
FIG. 3 provides a side, schematic view of certain components of an example icemaker appliance of FIG. 1.

FIG. 3 provides a schematic view of certain components of icemaker appliance 100. As may be seen in FIG. 3, ice maker 120 may include an ice mold 124 and a nozzle 126. Liquid water from nozzle 126 may be dispensed toward ice mold 124. For example, nozzle 126 may be provided below ice mold 124 within a first reservoir 128 and may dispense liquid water upward toward ice mold 124. As discussed in greater detail below, ice mold 124 is cooled by refrigerant. Thus, the liquid water from nozzle 126 flowing across ice mold 124 may freeze on ice mold 124, e.g., in order to form clear ice cubes on ice mold 124.

To cool ice mold 124, icemaker assembly 100 includes a sealed system 170. Sealed system 170 includes components for executing a known vapor compression cycle for cooling ice maker 120 and/or air. The components include a compressor 172, a condenser 174, an expansion device (not shown), and an evaporator 176 connected in series and charged with a refrigerant. As will be understood by those skilled in the art, sealed system 170 may include additional components, e.g., at least one additional evaporator, compressor, expansion device, and/or condenser. Thus, sealed system 170 is provided by way of example only. It is within the scope of the present subject matter for other configurations of a sealed system to be used as well.

Within sealed system 170, refrigerant flows into compressor 172, which operates to increase the pressure of the refrigerant. This compression of the refrigerant raises its temperature, which is lowered by passing the refrigerant through condenser 174. Within condenser 174, heat exchange with ambient air takes place so as to cool the refrigerant. A fan 178 may operate to pull air across condenser 174 so as to provide forced convection for a more rapid and efficient heat exchange between the refrigerant within condenser 174 and the ambient air.

The expansion device (e.g., a valve, capillary tube, or other restriction device) receives refrigerant from condenser 174. From the expansion device, the refrigerant enters evaporator 176. Upon exiting the expansion device and entering evaporator 176, the refrigerant drops in pressure. Due to the pressure drop and/or phase change of the refrigerant, evaporator 176 is cool, e.g., relative to ambient air and/or liquid water. Evaporator 176 is positioned at and in thermal contact with ice maker 120, e.g., at ice mold 124 of ice maker 120. Thus, ice maker 120 may be directly cooled with refrigerant at evaporator 176.

It should be understood that first ice maker 120 may be an air cooled ice maker in alternative example embodiments. Thus, e.g., cooled air from evaporator 176 may refrigerate various components of icemaker appliance 100, such as ice mold 124 of ice maker 120. In such example embodiments, evaporator 176 is a type of heat exchanger which transfers heat from air passing over evaporator 176 to refrigerant flowing through evaporator 176, and fan may circulate chilled air from the evaporator 176 to ice maker 120.

Icemaker appliance 100 also includes a controller 190 that regulates or operates various components of icemaker appliance 100. Controller 190 may include a memory and one or more microprocessors, CPUs or the like, such as general or special purpose microprocessors operable to execute programming instructions or micro-control code associated with operation of icemaker appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Input/output ("I/O") signals may be routed between controller 190 and various operational components of icemaker appliance 100. As an example, the various operational components of icemaker appliance 100 may be in communication with controller 190 via one or more signal lines or shared communication busses.

Icemaker appliance 100 includes first reservoir 128. First reservoir 128 may be provided within the ice storage compartment 102. For example, first reservoir 128 may be located at or near top portion 112 of interior volume 111 of ice storage compartment 102. First reservoir 128 may define a receiving space that holds water to be formed into ice. For example, an inner volume of first reservoir 128 may be smaller than interior volume 111 of ice storage compartment 102. In some embodiments, first reservoir 128 may hold other liquids, such as cleaning solutions, for example.

Ice maker 120 may be provided within first reservoir 128. In detail, evaporator 176 and ice mold 124 are located in first reservoir 128. First reservoir 128 may extend along the vertical direction V from a bottom end 202 to a top end 204. Ice maker 120 may be mounted at the top end 204 of the first reservoir 128. For example, evaporator 176 may be mounted to the top end 204 and ice mold 124 may be connected to evaporator 176. In some embodiments, ice mold 124 may be defined by evaporator 176. In other words, evaporator 176 is integral with ice mold 124 such that the clear ice I is formed directly on evaporator 176.

A first pump 142 may be provided within first reservoir 128. First pump 142 may pump water or liquid stored in first reservoir 128. A first circulation conduit 140 may be connected to first pump 142 such that the water or liquid pumped by first pump 142 is circulated through first circulation conduit 140. First circulation conduit may include a series of tubes or pipes capable of guiding the water or liquid pumped by first pump 142. A nozzle 126 may be provided at a downstream end of first circulation conduit 140. Nozzle 126 may dispense the water or liquid stored in first reservoir 128 toward ice maker 120 (i.e., ice mold 124 and/or evaporator 176). In one embodiment, nozzle 126 may be located near bottom end 202 of first reservoir 128. As such, the water or liquid may be sprayed in a generally upward direction from nozzle 126 toward ice maker 120. Accordingly, clear ice I may be formed on ice maker 120 due to a constant spray of water onto ice maker 120 while ice maker is cooled by a circulation of refrigerant through sealed system 170.

Icemaker appliance 100 may also be operated in a cleaning mode, or may perform a cleaning operation to clean the various pieces in icemaker appliance 100 that may become contaminated with foreign debris. For example, in some embodiments, cleaning solution or acid may be pumped through first circulation conduit 140 and dispensed by nozzle 126 toward ice maker 120. Accordingly, the cleaning solution or acid may remove the foreign contaminants or debris from, for example, ice mold 124, nozzle 126, first reservoir 128, and return line conduit 152.

A first liquid level sensor 134 may be provided in first reservoir 128. Generally, the first liquid level sensor 134 may sense a level of liquid contained within first reservoir 128. In some embodiments, first liquid level sensor 134 is in operable communication with controller 190. For instance, first liquid level sensor 134 may communicate with the controller 190 via one or more signals. In certain embodiments, first liquid level sensor 134 includes a predetermined threshold level (e.g., to indicate the need for additional liquid to first reservoir 128). In particular, first liquid level sensor 134 may detect if or when the liquid first reservoir 128 is below the predetermined threshold level. Optionally, first liquid level sensor 134 may be a two-position sensor. In other words, first liquid level sensor 134 may either be "on" or "off," depending on a level of water. For example, when the water level is below the predetermined threshold level, first liquid level sensor 134 is "off," meaning it does not send a signal to first pump 142 via controller 190 to pump water from first reservoir 128. For another example, when the water level is above the predetermined threshold, first liquid level sensor 134 is "on," meaning it sends a signal to first pump 142 via controller 190 to operate first pump 142. It should be understood that first liquid level sensor 134 may be any suitable sensor capable of determining a level of liquid within first reservoir 128, and the disclosure is not limited to those examples provided herein.

A filter 154 may be connected to first circulation conduit 140. The filter 154 may filter out solid contaminants from water in the first reservoir 128. The filter 154 may be provided downstream from first pump 142. Additionally or alternatively, filter 154 may be provided upstream from nozzle 126. In some such embodiments, filter 154 is provided along a flow path between first pump 142 and nozzle 126, such that water passes from first pump 142 through filter 154 before being dispensed by nozzle 126. The filter 154 may include a filter medium 156 which performs the actual filtration. For example, the filter medium 156 may be a deionization filter. Nonetheless, it should be understood that various additional or alternative suitable filter mediums or devices may be incorporated as filter medium 156.

A perforated ramp or series of slats 104 may be provided within the first reservoir 128. The ramp 104 may be located beneath the ice maker 102 (e.g., beneath the ice mold 124 or evaporator 176). In other words, ramp 104 may be located under ice maker 102 in the vertical direction V. A top surface of the ramp 104 (or top edges of the series of slats) may be angled. In other words, a first end of ramp 104 may be positioned higher in the vertical direction V than a second end of ramp 104. Thus, when ice is formed on ice maker 102 and harvested, the ice may fall onto ramp 104 and slide into ice storage compartment 102. In one example, as seen in FIG. 3, the ramp 104 is angled downward toward a front of cabinet 110. Accordingly, a passageway or hole may be provided on a side of first reservoir 128 through which the ice cubes may be ejected after sliding down ramp 104.

The ice maker 102 may further include a heater provided at or near ice mold 124. During a harvesting of the ice cubes formed on ice mold 124, the heater may be activated to heat ice mold 124 and subsequently release the ice cubes from ice mold 124. In one embodiment, the sealed system 170 may be turned off (i.e., no refrigerant is supplied to evaporator 176) and the heater may be turned on for a predetermined amount of time. The ice mold is then temporarily heated by the heater to release or harvest the ice cubes. The heater may be an electric heater, for example. However, it should be understood that various types of heaters may be used to heat ice mold 124, including a reverse flow of refrigerant through sealed system 170, for another example, and the disclosure is not limited to those examples provided herein.

The icemaker appliance 100 may further include a second reservoir 138. The second reservoir 138 may be in fluid communication with the ice storage compartment 102. A drain conduit 150 may connect ice storage compartment 102 with second reservoir 138 such that liquid from ice storage compartment 102 flows into second reservoir 138. In some examples, second reservoir 138 is provided beneath ice storage compartment 102. In other words, second reservoir 138 may be below ice storage compartment 102 in the vertical direction V. Accordingly, liquid from ice storage compartment 102 may easily flow into second reservoir 138 via drain conduit 150. In one example, when ice stored within ice storage compartment 102 melts to water, at least a portion of the melt water may flow from ice storage compartment 102 through drain conduit 150 into second reservoir 138. The second reservoir 138 may also be in fluid communication with the first reservoir 128. In other words, liquid from second reservoir 138 may flow to first reservoir 128. In one example, the second reservoir 138 is connected to the first reservoir 128 via a return line conduit 152. During use, at least a portion of the melt water from second reservoir 138 may be pumped to first reservoir to be recirculated through first circulation conduit 140 and redispensed onto ice maker 120.

A second pump 144 may be provided at or in second reservoir 138. During use, second pump 144 may selectively pump at least a portion of the melt water from second reservoir 138 to first reservoir 128. Generally, second pump 144 may be provided as any suitable fluid pump (e.g., rotary pump, reciprocating pump, peristaltic pump, velocity pump, etc.). Optionally, second pump 144 may be an immersion pump and may be located within second reservoir 138. In detail, second pump 144 may be submersible within second reservoir 138 (i.e., within a volume of liquid stored within second reservoir 138). Additionally or alternatively, second pump 144 may be located outside of second reservoir 138. In other words, second pump 144 may be outside the confines of second reservoir 138 such that second pump 144 is not in direct contact with liquid stored within second reservoir 138. Advantageously, second pump 144 may assist in recirculating liquid through icemaking appliance 100 to improve performance and reduce the need for cleaning or maintenance.

A second liquid level sensor 136 may be provided within second reservoir 138 to sense a level of liquid contained within second reservoir 138. Generally, the second liquid level sensor 136 may sense a level of liquid contained within second reservoir 138. In some embodiments, second liquid level sensor 136 is in operable communication with controller 190. For instance, second liquid level sensor 136 may communicate with the controller 190 via one or more signals. In certain embodiments, second liquid level sensor 136 includes a predetermined threshold level (e.g., to indicate the need to drain liquid from second reservoir 138). In particular, second liquid level sensor 136 may detect if or when the liquid in second reservoir 138 is below or above the predetermined threshold level. Optionally, second liquid level sensor 136 may be a two-position sensor. In other words, second liquid level sensor 136 may either be "on" or "off," depending on a level of water. For example, when the water level is below the predetermined threshold level, second liquid level sensor 136 is "off," meaning it does not send a signal to second pump 144 via controller 190 to pump water from second reservoir 138. For another example, when the water level is above the predetermined threshold, second liquid level sensor 136 is "on," meaning it sends a signal to second pump 144 via controller 190 to operate second pump 144. It should be understood that second liquid level sensor 136 may be any suitable sensor capable of determining a level of liquid within second reservoir 138.

Icemaking appliance 100 may further include a cleanout line 162. Cleanout line 162 may define a first end 164 and a second end 166. Each of first end 164 and second end 166 defines a point along the flow path through the cleanout line 162. In one example, first end 164 is connected to second reservoir 138. For instance, first end 164 defines an outlet of second reservoir 138 where liquid exits second reservoir 138 and enters cleanout line 162. In some embodiments, first end 164 is defined at a side of second reservoir 138. However, first end 164 may be connected to or defined at a bottom, front, or rear of second reservoir 138. Accordingly, liquid within second reservoir 138 may flow out of second reservoir through cleanout line 162. Second end 166 may be open to an external area. In other words, second end 166 may be exposed outside of icemaker appliance 100. Liquid flowing through cleanout line 162 may be released from icemaking appliance 100 via second end 166. Second end 166 may be provided at a front panel of cabinet 110. In other words, second end 166 may be exposed at a front portion of icemaker appliance 100 (e.g., below door 119). Advantageously, each component within icemaking appliance 100 may be easily cleaned by circulating a cleaning fluid therethrough and draining the cleaning fluid through cleanout line 162. Thus, a more thorough cleaning may be performed resulting in cleaner ice, fewer maintenance issues, and overall increase in operability.

In some embodiments, an access panel 106 may be provided on cabinet 110. Access panel 106 may provide selective access to an interior of icemaker appliance 100. For instance, a user may remove or open access panel 106 to gain access to components of icemaker appliance 100 (e.g., sealed system 170, cleanout line 162, etc.) Access panel 106 may be located on a front portion of cabinet 110. For example, access panel 106 may be located beneath door 119. Access panel 106 may be attached to cabinet 110 via a hinge. Accordingly, access panel 106 may be opened to allow access to second end 166 of cleanout line 162. Additionally or alternatively, access panel 106 may be removable from cabinet 110. A user may be able to completely remove access panel 106 from cabinet 110 in order to expose second end 166 to the ambient atmosphere outside of icemaking appliance 100.

A valve 108 may be connected to cleanout line 162. Valve 108 may be fluidly coupled to cleanout line 162 to allow cleanout line 162 to be open (e.g., allow fluid to flow through cleanout line 162) or closed (e.g., restrict fluid from flowing through cleanout line 162). The valve 108 may be selectively opened and closed to allow liquid to be released from second reservoir 138. The valve 108 may be any suitable valve, such as a mechanical valve or an electromechanical valve, for example. Optionally, the valve 162 may be in operable communication with controller 190. In some such embodiments, the valve 108 is selectively controlled by controller 190 (e.g., opened or closed according to a signal received from controller 190). For example, a user may select an operation in which the controller 190 directs the valve 162 to open for release liquid from second reservoir 138. Additionally or alternatively, a user may manually open the valve 162 and place a tray or bucket in front of the second end 166 of cleanout line 162 to collect liquid released from second reservoir 138.

Icemaker appliance 100 may include a water supply conduit 130 and a supply valve 132. Water supply conduit 130 is connectable to an external pressurized water supply, such as a municipal water supply or well. Supply valve 132 is coupled to water supply conduit 130, and supply valve 132 is operable (e.g., openable and closable) to regulate liquid water flow through water supply conduit 130 into icemaker appliance 100. In one embodiment, water supply conduit 130 is connected to first reservoir 128. In detail, water supply conduit 130 is in fluid communication with first reservoir 128 to allow external water to be supplied into first reservoir 128 via water supply conduit 130. Thus, e.g., first reservoir 128 may be filled with fresh liquid water from the external pressurized water supply through water supply conduit 130 by opening supply valve 132.

Figure 4:
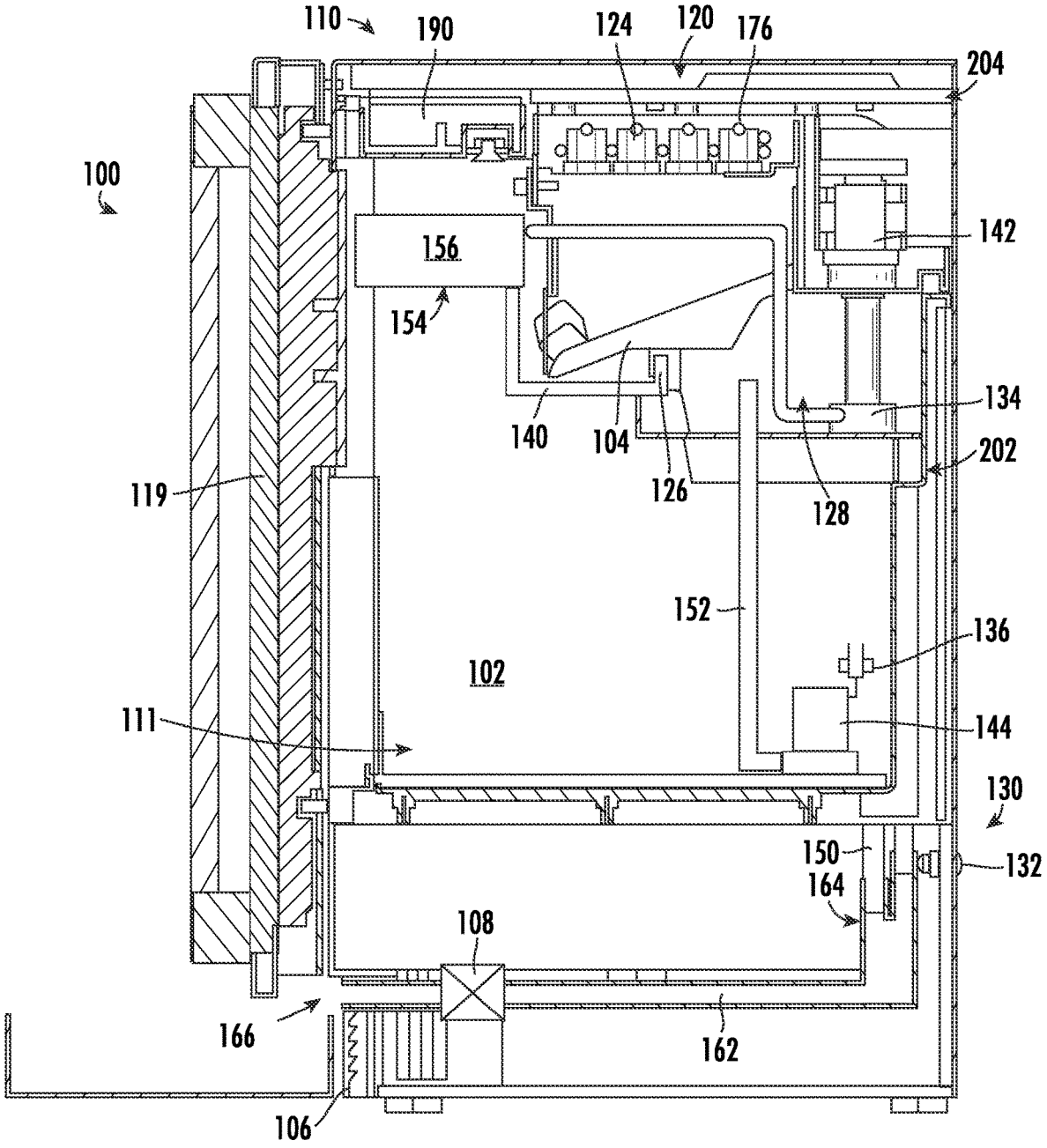
FIG. 4 provides a side, schematic view of certain components of another example icemaker appliance of FIG. 1.

FIG. 4 provides a side, schematic view of certain components of an icemaker appliance 100 according to another embodiment. Like reference numerals refer to like features, and as such a repeat description will be omitted. According to an alternate embodiment, second pump 144 may be provided within ice storage compartment 102. Second pump 144 may be a submersible type pump, such as a sump pump, for example. In detail, second pump 144 may be submersible within ice storage compartment 102 (i.e., within a volume of liquid stored within ice storage compartment 102). In some such embodiments, a second reservoir is omitted entirely. Return line conduit 152 may connect ice storage compartment 102 (via second pump 144) to first reservoir 128. Thus, upon activation of second pump 144, liquid in ice storage compartment 102 may be pumped through return line conduit 152 to first reservoir 128.

As shown, second pump 144 may include second liquid level sensor 136. In this embodiment, second liquid level sensor 136 may be a float type sensor. Accordingly, second liquid level sensor 136 may be directly attached to second pump 144. Additionally or alternatively, second liquid level sensor 136 may be provided separately form second pump 144 within ice storage compartment 102. Second liquid level sensor 136 may determine a level of liquid (e.g., melt water, cleaning solution) within ice storage compartment 102, and transmit the reading to controller 190. Controller 190 may then activate second pump 144 to pump the liquid from ice storage compartment 102 up to first reservoir 128 through return line conduit 152. First end 164 of cleanout line 162 may be connected directly to ice storage compartment 102. For example, first end 164 may be connected to a bottom of ice storage compartment 102 such that liquid within ice storage compartment 102 may easily flow into cleanout line 162. For another example, first end 164 may be connected to drain conduit 150. In detail, first end 164 may be in fluid communication with drain conduit 150, which is in turn in fluid communication with ice storage compartment 102. Accordingly, liquid may flow from ice storage compartment 102 through drain conduit 150 into cleanout line 162 via first end 164.

According to still another embodiment, icemaker appliance 100 may include a Venturi device in addition to or in place of second pump 144. The Venturi device may be provided within first reservoir 128 and may operate to draw liquid from ice storage compartment 102 into first reservoir 128. Accordingly, liquid from ice storage compartment 102 may be recycled into first reservoir 128 without the need for an additional pump.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An icemaker appliance, comprising:
- a cabinet forming an ice storage compartment;
- a first reservoir provided within the ice storage compartment;
- a circulation system arranged within the first reservoir, the circulation system comprising
  - a first circulation conduit,
  - a first pump connected to the first circulation conduit to pump liquid through the first circulation conduit, and
  - a nozzle downstream from the first circulation conduit to dispense liquid from the first circulation conduit;
- an ice maker provided within the first reservoir to dispense ice into the ice storage compartment;
- a second reservoir in fluid communication with the ice storage compartment so as to collect melt water from the ice storage compartment;
- a return line conduit connected to the second reservoir and the first reservoir to direct the melt water from the second reservoir directly to the first reservoir upstream from the ice maker;
- a second pump provided at the second reservoir to pump the melt water through the return line conduit; and
- a cleanout line having a first end connected to the second reservoir and a second end exposed outside of the cabinet, wherein the second end of the cleanout line terminates at at least one face of the cabinet.

2. The icemaker appliance of claim 1, further comprising a liquid level sensor in the second reservoir.

3. The icemaker appliance of claim 1, wherein the ice maker comprises a sealed cooling system and ice mold, the sealed cooling system having an evaporator positioned at the ice maker.

4. The icemaker appliance of claim 3, wherein the first reservoir extends along a vertical direction from a bottom end to a top end, and wherein the evaporator is mounted at the top end.

5. The icemaker appliance of claim 1, further comprising a valve provided on the cleanout line to selectively release liquid from the second reservoir.

6. The icemaker appliance of claim 5, wherein the valve is an electromechanical valve.

7. The icemaker appliance of claim 1, further comprising an access panel removably attached to a front of the cabinet, wherein the second end of the cleanout line is provided behind the access panel.

8. The icemaker appliance of claim 1, further comprising a water supply conduit and a supply valve, the water supply conduit connectable to an external water supply, the supply valve connected to the water supply conduit to regulate liquid water flow through the water supply conduit into the icemaker appliance.

9. The icemaker appliance of claim 8, wherein the water supply conduit is connected to the first reservoir.

10. The icemaker appliance of claim 1, further comprising a deionization filter connected to the first circulation conduit.

11. An icemaker appliance, comprising:
- a cabinet forming an ice storage compartment;
- a first reservoir provided within the ice storage compartment;
- a circulation system arranged within the first reservoir, the circulation system comprising
  - a first circulation conduit,
  - a first pump connected to the first circulation conduit to pump liquid through the first circulation conduit, and
  - a nozzle downstream from the first circulation conduit to dispense the liquid from the first circulation conduit,
- an ice maker provided within the first reservoir to dispense ice into the ice storage compartment;
- a return line conduit connected to the ice storage compartment and the first reservoir to direct melt water from the ice storage compartment directly to the first reservoir upstream from the ice maker;
- a second pump provided in the ice storage compartment to pump the melt water through the return line conduit; and
- a cleanout line having a first end connected to the ice storage compartment and a second end exposed outside of the cabinet.

12. The icemaker appliance of claim 11, further comprising a float switch in the second pump, wherein the float switch activates the second pump when the melt water reaches a predetermined level.

13. The icemaker appliance of claim 11, wherein the ice maker comprises a sealed cooling system and ice mold, the sealed cooling system having an evaporator positioned at the ice maker.

14. The icemaker appliance of claim 11, wherein the first reservoir extends along a vertical direction from a bottom end to a top end, and wherein the evaporator is mounted at the top end.

15. The icemaker appliance of claim 11, further comprising a valve provided on the cleanout line to selectively release liquid from the ice storage compartment.

16. The icemaker appliance of claim 15, wherein the valve is an electromechanical valve.

17. The icemaker appliance of claim 11, further comprising an access panel removably attached to a front of the cabinet, wherein the second end of the cleanout line is provided behind the access panel.

18. The icemaker appliance of claim 11, further comprising a water supply conduit and a supply valve, the water supply conduit connectable to an external water supply, the supply valve connected to the water supply conduit to regulate liquid water flow through the water supply conduit into the icemaker appliance.

19. The icemaker appliance of claim 18, wherein the water supply conduit is connected to the first reservoir.

20. The icemaker appliance of claim 11, further comprising a deionization filter connected to the first circulation conduit.

* * * * *